US005876217A

United States Patent [19]

Ito et al.

[11] Patent Number: 5,876,217

[45] Date of Patent: Mar. 2, 1999

[54] ELECTRIC CONNECTOR ASSEMBLY WITH IMPROVED RETENTION CHARACTERISTICS

[75] Inventors: Tomoaki Ito, Machida; Shinichi Aihara, Ebina; Toshihiro Niitsu, Yokohama, all of Japan

[73] Assignee: Molex Incorporated, Lisle, Ill.

[21] Appl. No.: 816,225

[22] Filed: Mar. 12, 1997

[30] Foreign Application Priority Data

Mar. 14, 1996 [JP] Japan ..... 8-085735
Feb. 7, 1997 [JP] Japan ..... 9-001005 U

[51] Int. Cl.[6] ..... H01R 9/09

[52] U.S. Cl. ..... 439/74

[58] Field of Search ..... 439/74, 81, 83, 439/733.1, 60, 637, 660, 292, 293, 284, 346

[56] References Cited

U.S. PATENT DOCUMENTS

| | | | |
|---|---|---|---|
| 4,734,060 | 3/1988 | Kawawada et al. | 439/660 |
| 4,993,956 | 2/1991 | Pickles et al. | 439/76 |
| 5,057,028 | 10/1991 | Lemke et al. | 439/101 |
| 5,116,247 | 5/1992 | Enomoto et al. | 439/660 |
| 5,167,528 | 12/1992 | Nishiyama et al. | 439/489 |
| 5,176,541 | 1/1993 | Mori | 439/736 |
| 5,181,855 | 1/1993 | Mosquera et al. | 439/74 |
| 5,192,232 | 3/1993 | Lenz et al. | 439/660 |
| 5,199,884 | 4/1993 | Kaufman et al. | 439/74 |
| 5,199,885 | 4/1993 | Korsunsky et al. | 439/79 |
| 5,224,866 | 7/1993 | Nakamura et al. | 439/81 |
| 5,277,597 | 1/1994 | Masami et al. | 439/83 |
| 5,310,357 | 5/1994 | Olson | 439/346 |
| 5,382,168 | 1/1995 | Azuma et al. | 439/65 |
| 5,395,250 | 3/1995 | Englert, Jr. et al. | 439/65 |
| 5,476,389 | 12/1995 | Ono | 439/637 |
| 5,498,167 | 3/1996 | Seto et al. | 439/74 |

FOREIGN PATENT DOCUMENTS

| | | | |
|---|---|---|---|
| 7-16381 | 3/1995 | Japan | H01R 23/02 |

*Primary Examiner*—Neil Abrams
*Assistant Examiner*—Barry M-L. Standig
*Attorney, Agent, or Firm*—James C. Paschall

[57] ABSTRACT

A connector assembly with improved retention characteristics includes opposing plug and receptacle connector housings, each containing conductive terminals. The terminals of one of the connector housings, preferably the plug connector housing include body portions with separate contact and locking portions extending upwardly therefrom and spaced apart from each other define a nest therebetween. The nest receives a portion of the other connector housing and the terminal contact and locking portions engage opposing sides of the other connector housing portion. The contact portions fictionally engage the other connector housing terminals while the locking portions positively engage recesses formed in the other connector housing.

20 Claims, 8 Drawing Sheets

ELECTRIC CONNECTOR ASSEMBLY WITH IMPROVED RETENTION CHARACTERISTICS

BACKGROUND OF THE INVENTION

The present invention relates generally to electrical connectors of reduced size, and more particularly to surface mount miniature connector assemblies with improved means for holding the components of the connector assembly together.

The trend of the electronics industry is to constantly reduce the size of electronic devices. Many electronic devices rely upon circuitry formed upon various printed circuit boards. These printed circuit boards must be joined together with connectors in a manner to effectively and reliably interconnect the circuits on one circuit board to the circuits on another circuit board.

In order to permit the connection of two circuit boards in parallel planes and to reduce the size of electronic devices, the connector industry developed the surface mount connector. A typical surface mount connector utilizes a plug-type male connector component that unites with an opposing receptacle-type, or female connector component. Both connector components are of low profile, allowing the circuit boards to be closely spaced to each other. When the connector components are engaged together, the mating terminals of the connector components form an electrical connection between the circuits of the two circuit boards.

It is desirable to retain the connector components in engagement with each other and to fulfill their need, locking mechanisms have been developed for such connectors. The use of locking mechanisms that are separate from the connector components may lead to more complex structure and larger sizes of connectors. When the locking mechanisms are formed as part of the connector component housings, they waste space that could be used on the connector and because the mechanisms are made entirely from plastic, such as that described in U.S. Pat. No. 5,199,884, issued Apr. 6, 1993, the locking mechanism will not be that strong.

In some connection applications the size of the connector portions themselves are extremely small, in what is known as the "micro-miniature" range where the connectors may have length and width dimensions as small as approximately 5 mm by 2 mm and height dimensions as small as approximately 2 mm. The approach in the industry with small size connectors is to utilize frictional force to hold the connectors together. However, such frictional forces will not always reliably resist accidental unmating. Additionally, insertion forces cannot be so excessive as to cause difficultly in mating such connectors. Accordingly, the need exists for a surface mount board to board connector that has a high degree of mechanical integrity and a sufficiently strong withdrawal force and a sufficiently light insertion force.

The present invention is therefore directed to an electric connector assembly which overcomes the aforementioned disadvantages and assures a stable holding force to hold the associated connector components together no matter how small the connector size.

SUMMARY OF THE INVENTION

To attain this and other objects, an electric connector assembly constructed in accordance with the principles of the present invention and as exemplified by a first embodiment thereof comprises a pair of connector components, each of the components having an insulative housing and a plurality of terminals fixed to the housing and arranged at regular intervals therein. The connector assembly has a first locking, or retention mechanism, in that the terminals of one of the connector components have locking portions formed thereon that are adapted to engage one or more catches formed on the other connector housing in position so that the one connector component terminals engage the other connector component catches when the two connector components are mated together with their terminals engaged with each other, thereby fastening and retaining the connector components together.

In a modification of this first embodiment, the catches may be formed in the housing of the other connector component to permit the locking portions to disengage therefrom upon application of a suitable withdrawal force and the catches may be formed therein to catch only selected terminal locking portions in the housing of the one connector component.

Another object of the present invention is to provide a method of making an electric connector assembly which is designed so as to provide a desired holding force with which the associated connectors can be held together irrespective of the number of terminals used or the condition in which the connector assembly may be used.

To attain this object, a method of making an electric connector assembly in accordance with the present invention permits a pair of connector housings to be mated together with a controlled holding force, each connector housing having an insulative housing and a plurality of terminals disposed therein and arranged at regular intervals along the housing, comprises the steps of: forming at least one connector assembly locking portion in terminals of one of the connector components; and, forming at least one opposing catch in the housing of the other connector component at such positions that each catch will engage a selected terminal locking portion when the connector components are mated together with their terminals engaged with each other. The number of terminal locking portions, catches and their distribution may be determined so as to provide a desired strength of holding force with which the connectors may be fastened and held together.

The locking portions of the terminals of the one connector components are caught by the catches formed in the other connector housing without fail, thereby applying the desired and required strength of holding force to the coupled connectors. Also, a desired level of retention force can be obtained by using as many locking portions as are required for the purpose, and a stable holding condition can be obtained by distributing such locking portions in an appropriate pattern for the purpose.

In another aspect of the present invention, and as exemplified by a second embodiment of the invention, the terminals are stamped and formed from conductive metal blanks to define on each terminal, a body portion, a contact portion extending therefrom, a locking portion extending and a solder tail portion extending therefrom, the contact and locking portions of the terminal being spaced apart from each other to define a space or nest therebetween that receives a portion of the other connector component housing therein. In this arrangement, the terminal locking and contact portions oppose each other. The terminal locking portions may be formed with the housing engagement portions in a vertical fashion which further reduce the horizontal or width dimensions of the connector assembly. The engageable terminal locking portions and the housing catches are generally arranged in alignment with a widthwise axis of the connector assembly.

It will be seen that the present invention reliably increases the mechanical integrity of the connection attained by connectors of the invention. The invention provides a surface mount, board-to-board connector assembly, or at least one component used in such an assembly that with a two or three component insertion force and also provides additional withdrawal force while ensuring stability of the connector in the lateral directions.

BRIEF DESCRIPTION OF THE DRAWINGS

In the course of the following detailed description reference will be frequently made to the accompanying drawings in which.

DESCRIPTION OF THE PREFERRED EMBODIMENTS

Figure 1:
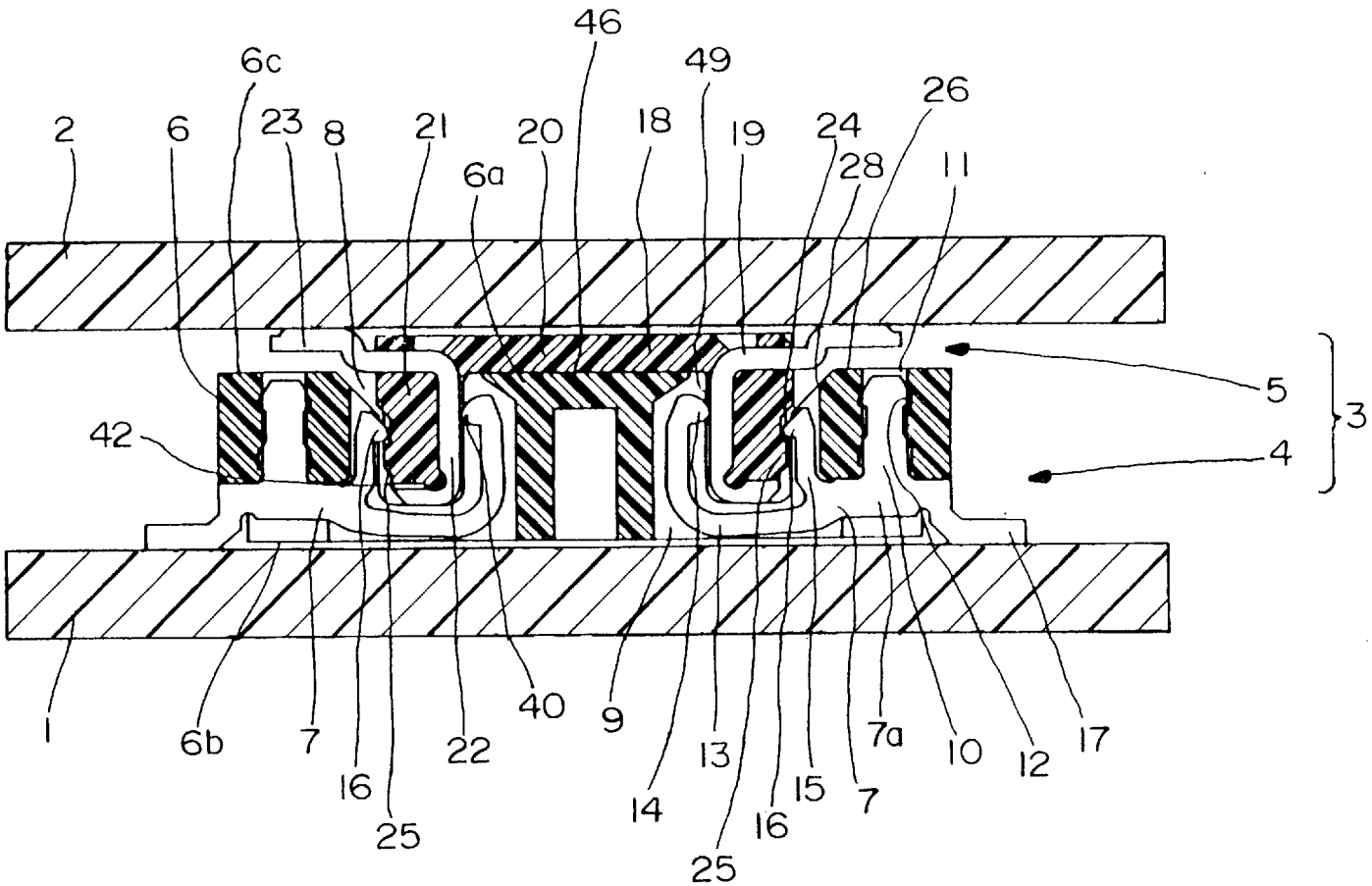
FIG. 1 is a cross-sectional view of one embodiment of an electric connector assembly constructed in accordance with the principles of the present invention.
Figure 2:
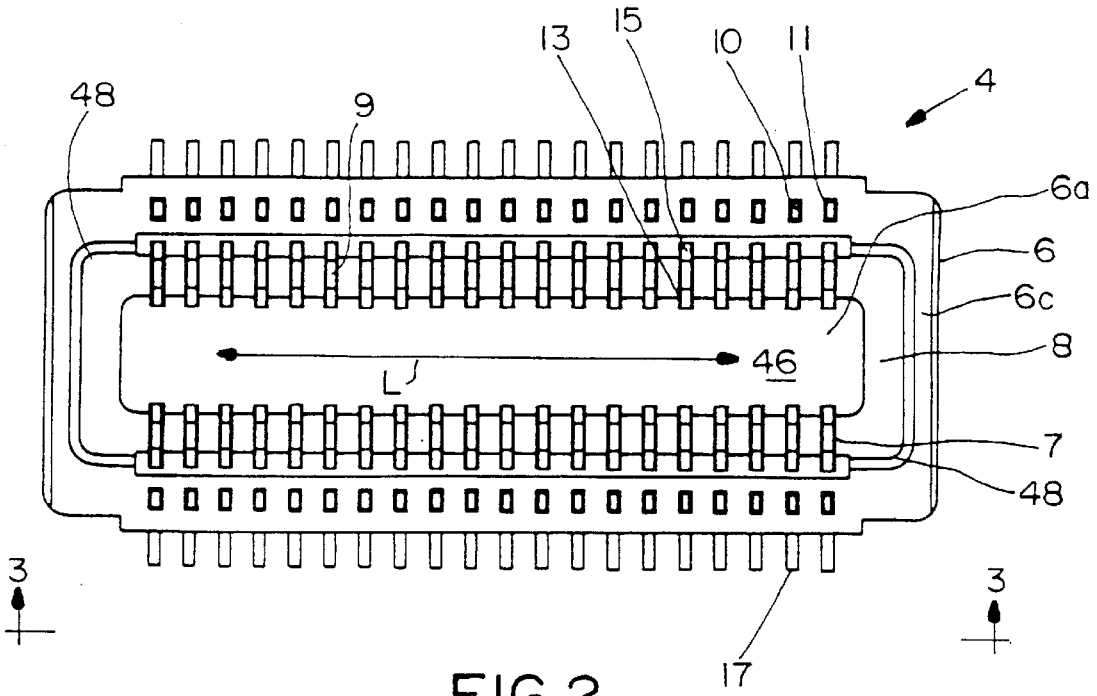
FIG. 2 is a plan view of the plug connector component of the electric connector assembly of FIG. 1.
Figure 3:
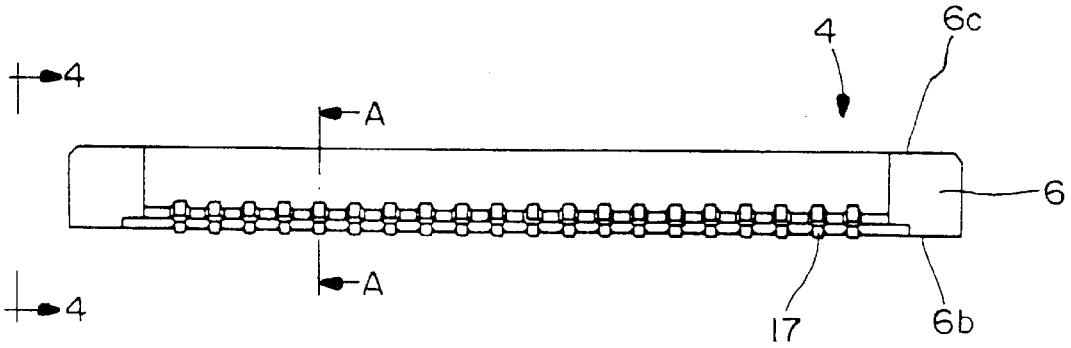
FIG. 3 is a side elevational view of the plug connector component of FIG. 2 taken along lines 3—3 thereof.
Figure 4:
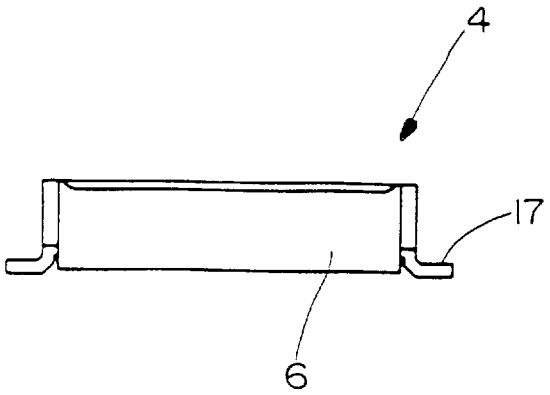
FIG. 4 is an end elevational view of the plug connector component of FIG. 3 taken along lines 4—4 thereof.
Figure 5:
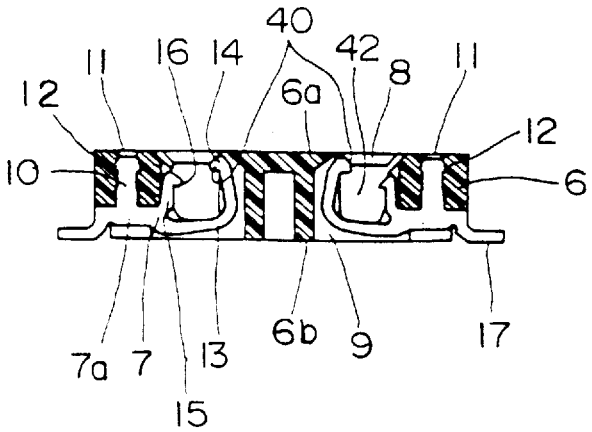
FIG. 5 is a cross-section of the plug connector component taken along line A—A in FIG. 3.

Referring to the drawings, FIGS. 1–9 illustrate a first embodiment of an electric connector assembly 3 constructed in accordance with the principles of the present invention. It can be seen that the connector assembly 3 comprises a pair of connector components 4, 5 for connecting one printed circuit board 1 to another printed circuit board 2. The plug connector component 4 is shown as fixed to the printed circuit board 1, while the receptacle connector component 5 is shown as fixed to the other printed circuit board 2.

Referring now to FIGS. 2 to 5, the plug connector component 4 can be seen to include a housing 6 of an insulative material, such as plastic, and a plurality of conductive terminals 7 arranged at regular intervals along the length L of the connector component 4. The terminals 7 are arranged in two distinct sets, or arrays, and are fixed to the insulative housing 6. The plug connector component housing 6 has a rectangular central portion, shown as a pedestal 6*a*. The pedestal 6 is surrounded by a series of sidewalls 6*c* that cooperatively define a mating opening 8 therebetween in which a portion 21 of the other connector component 5 fits. A plurality of terminal-receiving slots 9 are formed at regular intervals lengthwise along opposing sides of the rectangular pedestal 6*a* and sidewalls 6*c* that extend to the bottom surface 6*b* of the housing 6. The terminals 7 are inserted into the terminal slots 9 from the bottom surface 6*b* of the plug connector component housing 6*a*. The plug connector component 4 center pedestal 6 may include, if desired, a substantially flat or planar top surface 46 that permits the plug connector component 4 to be assembled into a circuit board 1 with a vacuum pick and place mechanism. The top surface 46 is preferably sufficiently broad to protect the top of the contact heads 14 from impact during mating with the receptacle connector which could adversely deform the contact portion 13.

The terminals 7 used in the plug connector component 4 may be formed from metal blanks in a known manner, such as by stamping and forming, and each terminal includes a horizontal base or body portion 7*a*, a contact portion 13 having a free end 40 with a general L-shape that extends from and is integrally connected to a front part of the terminal base portion 7*a*, a connector locking portion 15 rising from the base portion 7*a* (shown at the midpoint thereof), a housing retention portion 10 rising from the base portion 7*a* and a solder tail 17 extending generally horizontally from the rear side of the base portion 7*a*.

The contact portion 13 of the terminal has a contact head 14 formed thereon, while the locking portion 15 of the terminal 7 has a locking head 16 projecting from its free end thereof. The contact head 14 and the locking head 16 oppose each other as shown (FIG. 1) and are spaced apart from each other to define an intervening space, or nest 42 therebetween. The retention portion 10 preferably includes a series of projections 12 in the form of barbs or the like formed on its opposite sides that positively engage opposing surfaces of the housing 6 in a known manner. As best seen in FIG. 1, the plug connector component housing 6 has a plurality of terminal-mounting holes 11 formed therein along the outer walls thereof, each of the mounting holes 11 being preferably aligned in one-to-one order with each terminal slot 9 in order to accommodate the retention portions 10 of the terminals 7.

Each terminal 7 may be assembled in the plug connector component housing 6 by press-fitting its retention portion 10 into the mounting holes 11 of the housing 6. The press-fit enables the retention barbs 12 of the engagement portions 10 to cut into the opposing inner walls of the hole 11, to positively retain the terminals 7 in their place on the plug connector component housing 6. In its position, each terminal 7 is maintained stationary in the plug connector component housing 6 with its contact portion 13 and locking portion 15 facing each other, and defining the nest 42 that receives therein a portion of the other connector component 5 and an associated terminal 19 thereof. The solder tail portions 17 of the terminals 7 extend outwardly of the plug connector component housing 6 for effective and reliable mounting to a mounting surface of the one circuit board 1.

Figure 9:
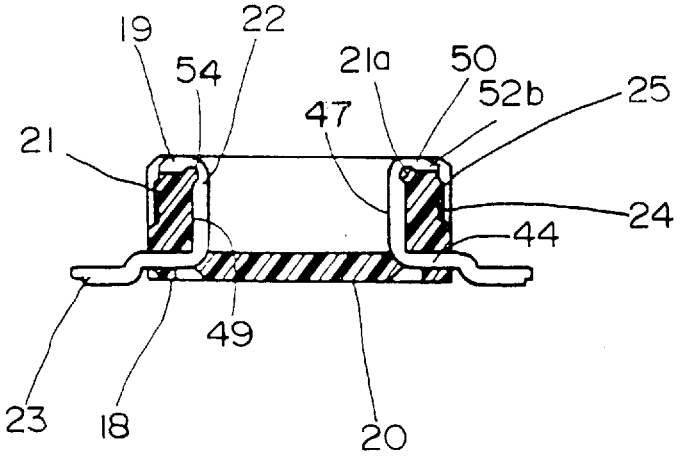
FIG. 9 is a cross-section of the receptacle connector component taken along line B—B of FIG. 7.

Referring now to FIGS. 6 to 9, it can be seen that the other connector component 5 takes the form of a receptacle connector and includes an insulative housing 18 of plastic (commonly called "wafer") and a plurality of conductive terminals 19 longitudinally arranged in the housing 18 at regular intervals in two distinct sets. The rectangular housing 18 is designed to mate with its counterpart housing 6 of the plug connector 4, and as such, it includes a base plate 20 and a surrounding frame or sidewalls 21. (FIG. 9.) The receptacle terminals 19 are fixed to the sidewalls 21 of the receptacle connector component housing 18 in a convenient manner such as by insert molding them in the housing 18.

Figure 6:
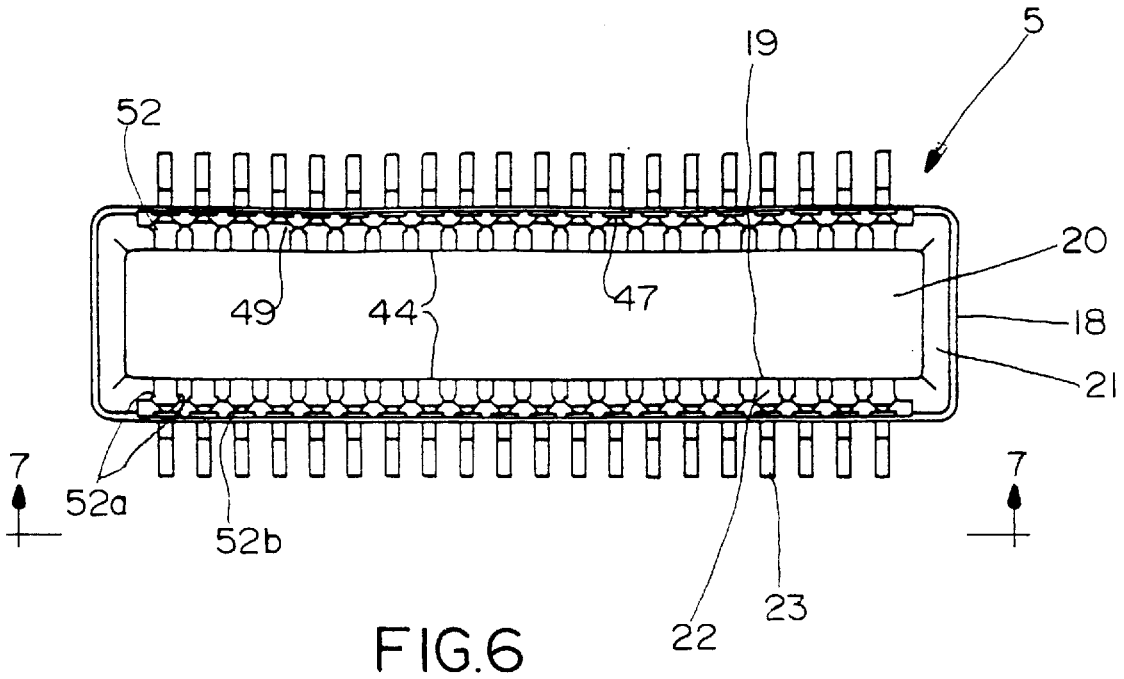
FIG. 6 is a plan view of the receptacle connector component of the electric connector assembly of FIG. 1.

The receptacle connector component terminals 19 are also preferably formed from metal blanks by stamping and forming. Each terminal 19 comprises a horizontal base or body portion 44, a contact portion 22 vertically extending therefrom and a horizontal top portion 50 orthogonally extending from the contact portion 22 and adjacent the top edge of the sidewall 21. The contact portion 22 and the top portion 50 have outer surfaces embedded in the sidewall 21 of the receptacle housing 5, and inner surfaces exposed. As best seen in FIG. 6, the top portion includes a triangular retaining head 52 with outer edges 52*a* that extend outwardly of the edges of the top portion 50 for anchoring the top portion in the sidewalls 21 and prevent the terminal 19 against moving inwardly. The retaining head 52 also has a chamfered tip 52*b* to facilitate mating. An inner corner of an intersection 51 between the top portion 50 and the contact portion 22 includes a radiused recess 54. The recess is stamped in the receptacle terminal 19 before the top portion 50 is bent with respect to the contact portion 22 to facilitate bending. Upon insert molding the terminal 19 in the housing 18, the plastic of the sidewall 21 fills in the recess 54 to form a protrusion 21*a*. The outermost edge of the recess 54 abuts against the outermost edge of the protrusion 21*a* to further prevent the terminal 19 from moving inwardly. The outer corner of the intersection 51 is also radiused.

A solder tail portion 23 extends horizontally from the rear of the base portion 44. The terminals 19 are preferably arranged at the same spacing as are the terminals 7 of the plug connector component 6. In this orientation, the inner surface of the contact portion 22 of each terminal 19 lies flush upon the inner surface 49. As shown in FIG. 1, the solder tail portion 23 is mounted on a surface of the other circuit board 2.

Figure 7:
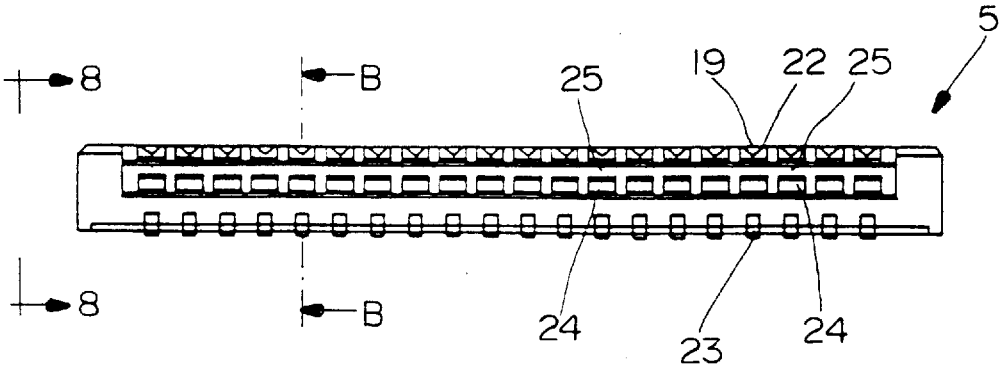
FIG. 7 is a side elevational view of the receptacle connector component of FIG. 6 taken along lines 7—7 thereof.
Figure 8:
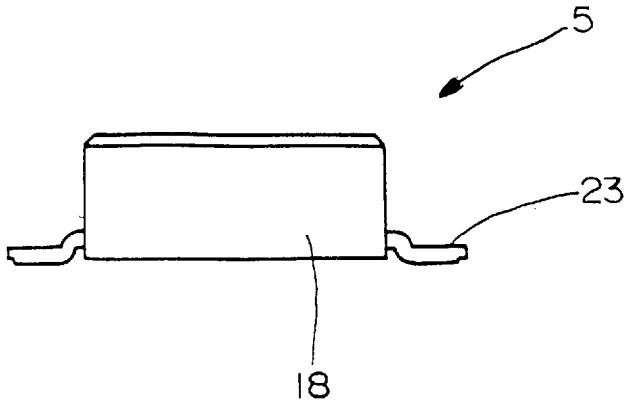
FIG. 8 is an end elevational view of the receptacle connector component of FIG. 6 taken along lines 8—8 thereof.

As best seen in FIG. 9 and in an important aspect of the present invention, each longitudinal sidewall 21 of the receptacle housing 18 has a plurality of recesses 24 formed on its outer surface which are intended to engage or "catch" the locking heads 16 of the terminal locking portions 15 of the plug connector component 4 when the plug and receptacle connector components 4, 5 are mated together. As seen in FIGS. 7 & 9, each such recess 24 has an abutment 25, or shoulder, formed at its top. This shoulder 25 provides a surface against which the plug connector terminal locking portion locking heads 16 catch and they cooperatively define one mass of retaining the connector components 4, 5 together in an interlocked condition. The sidewalls 21 of the receptacle connector component 5 may be slanted as are the chamfered tips 52*b* of the retaining head 52 of the terminal 22 as shown in FIG. 1. Top surfaces 26 of the sidewalls 6*c* of the plug housing 6 and the top surface 46 of the pedestal all lie in the same plane. The sidewalls 6*c* of the plug housing preferably include chamfered inner edges 28. During mating, the exposed surface of the top portion 50 of receptacle terminals 19 slide along the planar surfaces 26 and 46 and chamfered surfaces 28 cooperate with slanted sidewalls 21 of the receptacle connector component 5 to guide the receptacle connector component 5 into engagement with the plug connector 4. Additionally, the contact head 14 rides along the radiused outer corner of the intersection 51 to facilitate mating. These features are beneficial for the blind mating engagement situation in which the present invention is used.

FIG. 1 illustrates the two plug and receptacle connector components 4 and 5 mated together. The solder tail portions 17 of the terminals 7 of the plug connector component 4 are soldered to the one printed circuit board 1, whereas the solder tail portions 23 of the terminals 19 of the receptacle connector component 5 are soldered to the other printed circuit board 2. The mating opening 8 of the plug connector component housing 6 is positioned over the receptacle connector housing sidewalls 21 and the two connector components 4, 5 are pressed together into engagement. The contact heads 14 of the plug connector terminal contact portions 13 are preloaded slightly by their shape which extends the contact heads 14 of the terminal contact portions 13 toward the interior of the plug connector component 4 due to their shape. This preloading causes the plug connector terminal contact portions 13, and particularly the contact heads 14 thereof, to fictionally engage the receptacle connector terminal contact portions 22 and thereby establish an electrical connection between the printed circuit boards 1 and 2. Additionally, as seen in FIG. 1, the locking heads 16 of the plug connector component terminal locking portions 15 ride upon the surfaces of the receptacle component sidewalls 21 until they are caught in the recesses 24 to lie against the shoulders 25 defined thereon.

The interengagement of the terminal locking portions 15 and the receptacle catches 24 reliably retains the two connector components 4, 5 together. It can be seen from FIG. 1 that the contact heads 14 and the locking heads 16 of the terminals 7 are spaced apart from each other at different elevations relative to their position within the plug connector housing 6. This staggers their order of engagement with the opposing connector component 5. First, the contact portions 13 of the plug connector terminals 7, particularly the contact heads 14 thereof, engage the radiused outer corner of the intersection 51 of the terminals 19 of the receptacle connector 5. Second, the plug connector terminal locking portions 15, particularly the locking heads 16 thereof, engage the chamfered tip 52*b* of the receptacle terminals 19 of the receptacle connector 5. Thus, a "two-stage" insertion action is effected.

The two stage insertion action dilutes the insertion force. Because the plug terminal contact head 14 engages the outer corner of the intersection 51 at a different time than the plug terminal locking head 16 engages the chamfered tip 52*b*, the initial engagement forces do not cumulatively operate to resist insertion, thereby diluting the insertion force. To further dilute the insertion force, the radiused outer corner of intersection 51 and the chamfered tip 52*b* of the receptacle terminal 19 facilitate movement of the heads 14 and 16 toward their final insertion position against the receptacle terminal contact portion 22 and the receptacle recess 24, respectively.

The retention or interlocking force exerted by the terminals 7 may be selectively chosen for the connector assembly 3 by increasing or decreasing the number of engagements between the terminals 7 and the opposing connector component 5. The retention force with which the plug and receptacle connector component housings are fastened together increases as the number of terminal locking portions 15 of the plug connector components 4 increase. A desired retention force can be obtained by determining the number and distribution of these elements in consideration of the overall number of terminals 7, 19 used in the connector assembly 3. This retention force is additionally increased by the resultant frictional forces that occur between the nested terminals 7, 19.

For one example, twenty plug and receptacle terminals 7 and 19 may be used to make up a single set of terminals on either of the plug and receptacle connector housings 4, 5, and the receptacle connector housing 18 may have a like number of recesses 24 as the number of plug terminal locking portions 15. For another example, when one hundred plug and receptacle terminal 7, 19 may make up a single set of terminals on either longitudinal side of each of the plug and receptacle connector housings, each plug terminal 7 may have a locking portion 15 and a locking head 16, but the receptacle connector housing 18 may have no catch recesses 24, yet the intersection between the two will still provide a desired holding force due to friction between the plug terminal contact heads 14 of the plug terminals 7 and the receptacle terminal contact portions 22. For still another example, between thirty to eighty plug and receptacle terminals 7, 19 make up a single line on either longitudinal side of each of the plug and receptacle connector housings, while a sequentially decreasing number of plug terminals 7 are selected in different locations in the plug housing 6 to have a locking head 16 formed thereon, and the receptacle connector housing 18 has an equal amount of catch recesses 24 as the selected plug terminals 7. The selected plug terminals and catch recesses are distributed along the connector components so as to provide a desired retention force to assure the stable nesting of the plug and receptacle connectors.

The required distribution of catch recesses 24 can be advantageously obtained by removing the abutment 25 of selected catch recesses made in the mold of the receptacle connector housing 18. Production molds can be designed so as to make a desired number and distribution of recesses in the other connector component in consideration of the number of terminals used in the one connector component. The latching of the terminals 7 with their opposing associated recesses 24 may be distributed lengthwise along the connector component housings in a manner to assure the stable retention of the plug and receptacle connector components when mated together.

As may be understood from the above, this type of latching in an electric connector assembly according to the present invention assures the even distribution of holding force over the mating area of the connector components. Also, advantageously a desired strength of holding force can be obtained, and reliable coupling of the connector components is assured without requiring any extra operation. Insofar as micro-miniature connectors are concerned, the present invention increases the overall mechanical integrity of the connector assembly 3 in that the metal terminals 7 of the plug connector 4 also exert a frictional retention force on the opposing connector component 5 as explained in greater detail below. The combination of the direct engagement by the terminal locking portions 15 of the plug connector 4 with recesses 24, coupled with the frictional engagement by the contact portions 13 of the plug connector 4 with the contact portions 22 of the receptacle connector 5 increases the withdrawal force necessary to separate the connector components 4, 5 apart. Thus, with this "two-stage" retention capability, the likelihood of accidental unmating of the connector components 4, 5 of the connector assembly 3 and their corresponding circuit boards 1, 2 is significantly decreased.

Figure 10:
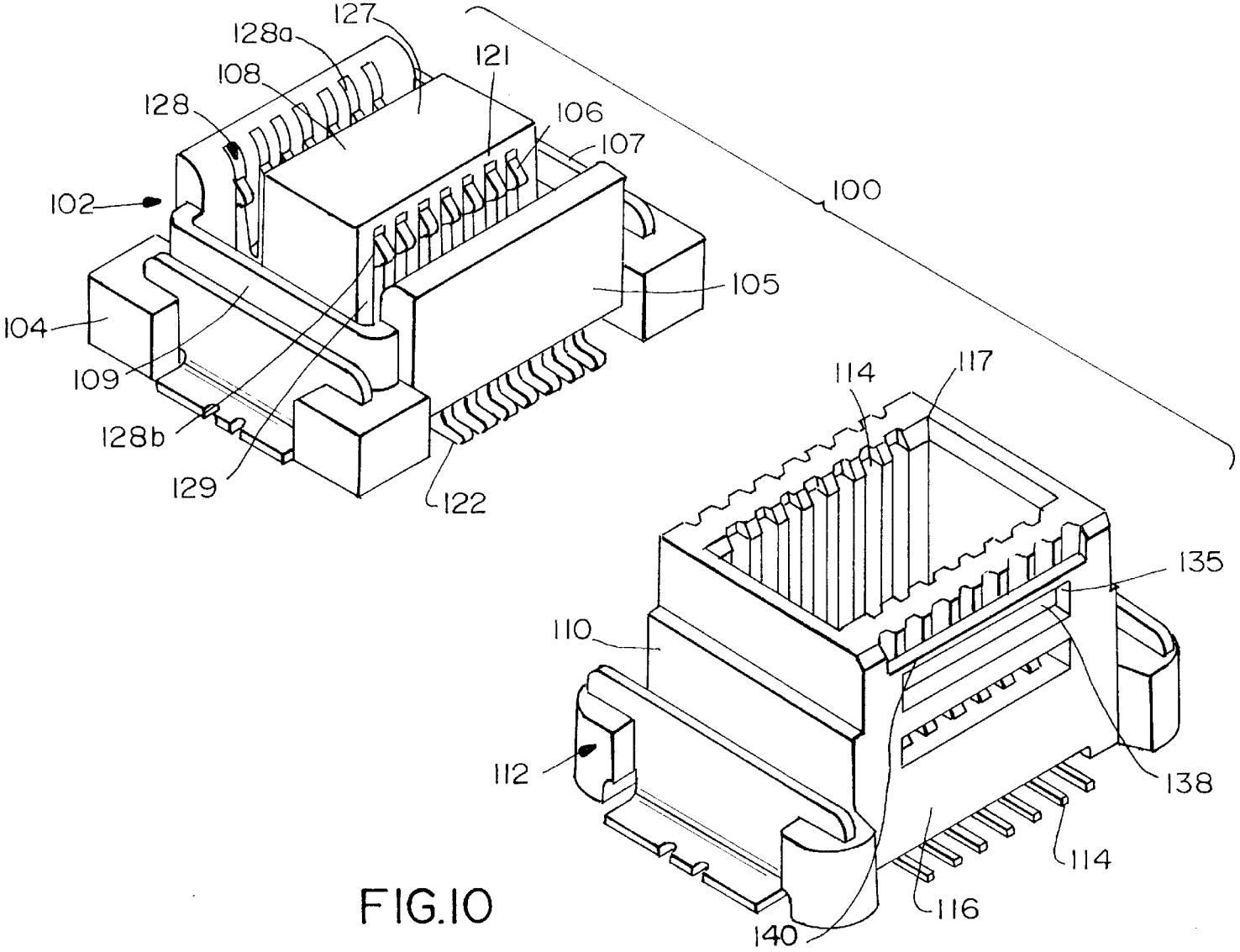
FIG. 10 is a perspective view of two interengaging connector components that when engaged together make up another embodiment of a connector assembly in accordance with the principles of the present invention.
Figure 11:
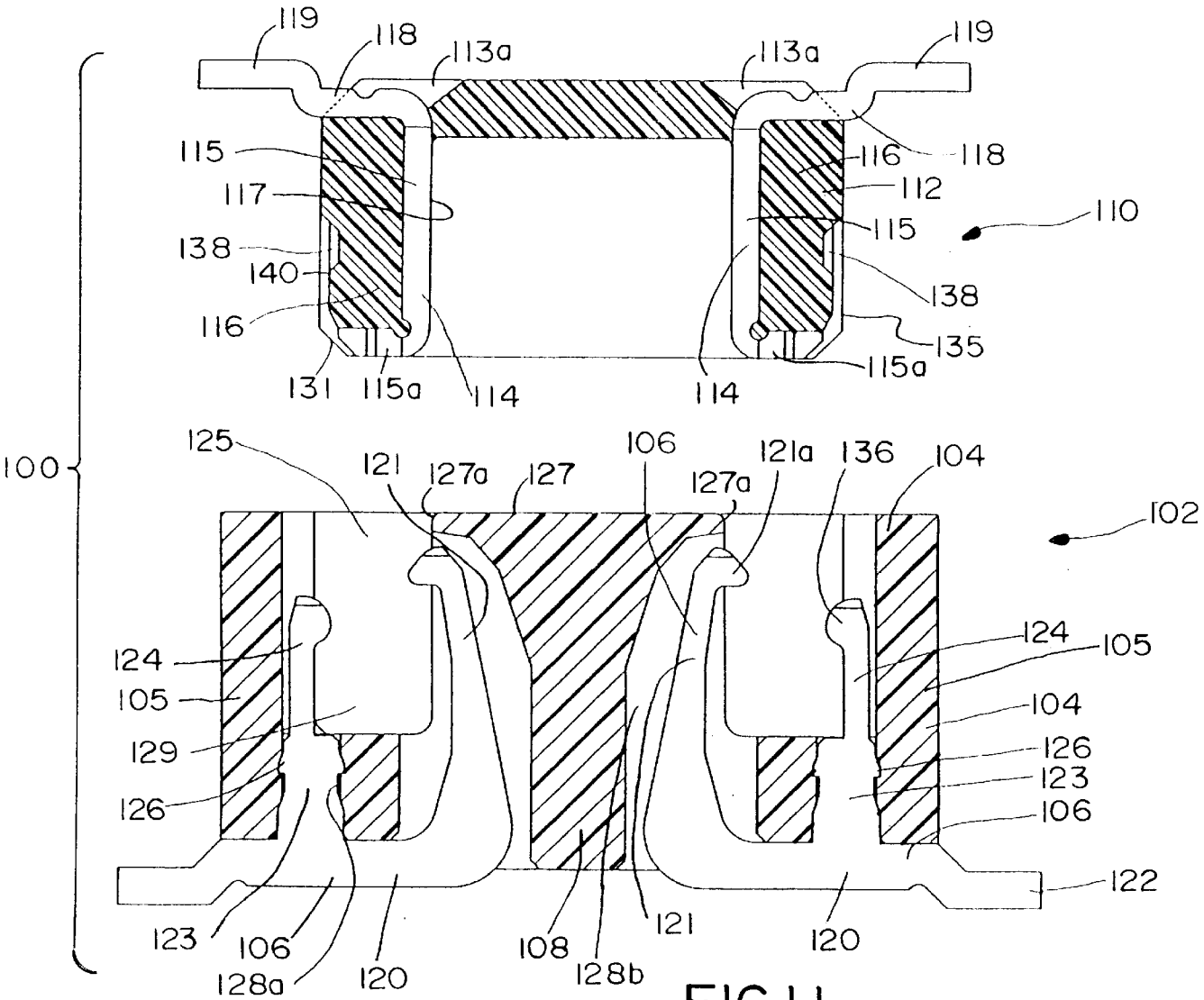
FIG. 11 is a transverse cross-sectional view of the two connector components of FIG. 10.
Figure 12:
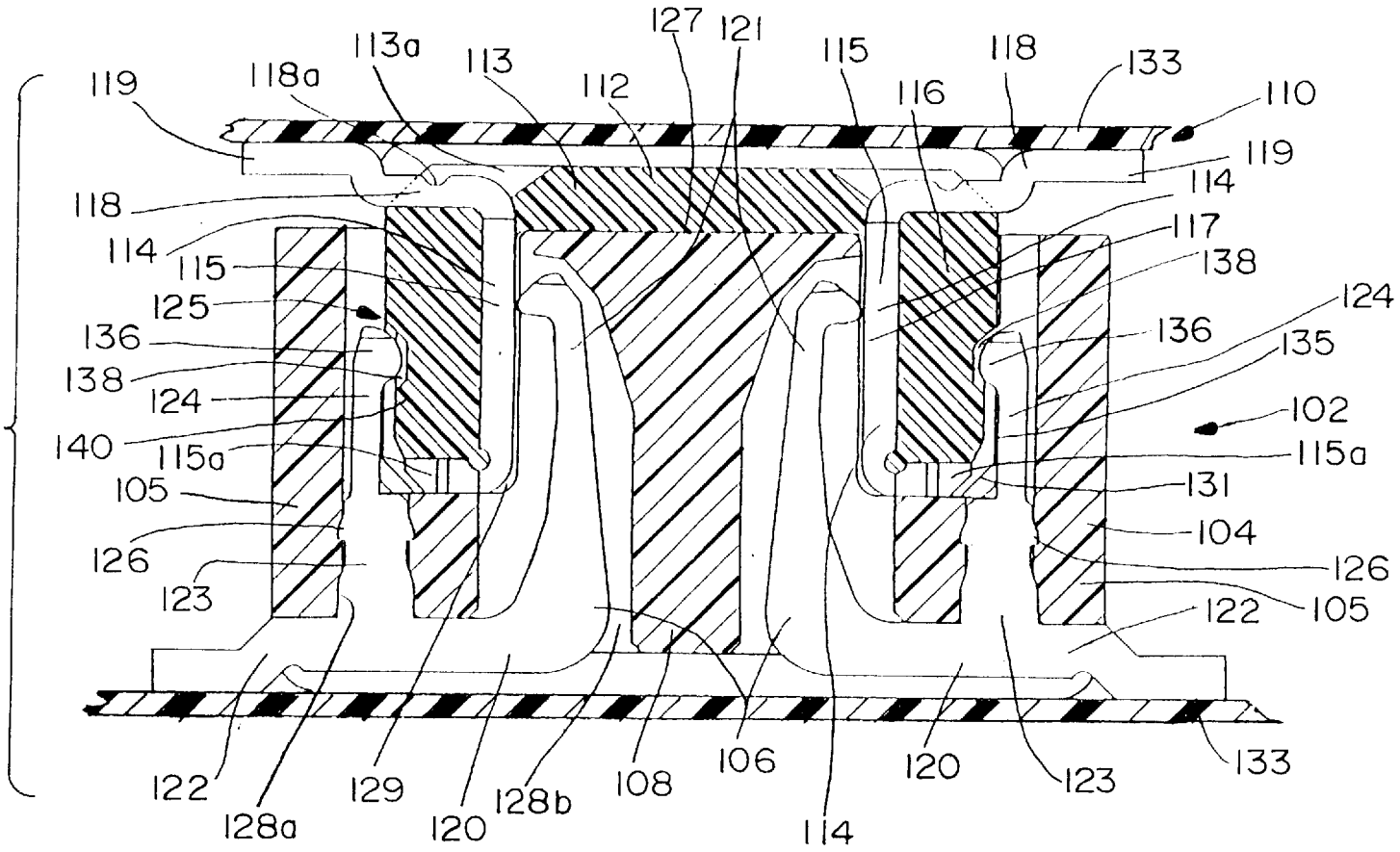
FIG. 12 is a transverse cross-sectional view of the connector components of FIG. 10 engaged together.

Turning generally now to FIGS. 10 through 12, a second embodiment of a connector assembly constructed in accordance with the principles of the present invention is shown generally at 100. The connector assembly 100 shown includes a surface mount male, or plug connector component 102, having an insulative housing 104 and a plurality of terminals 106 disposed therein in two distinct sets. Each set of terminals 106 of the plug connector component 100 is disposed along opposite sides of a central pedestal 108 of the plug connector 102. A surface mount female, or receptacle connector component 110, also has an insulative housing 112 having a floor 113 and two sets of terminals 114 disposed therein, preferably in the sidewalls 116 of the receptacle housing 112, so that they will oppose and contact the terminals 106 of the plug connector component 102 when the two components 102, 110 are mated together as in FIG. 12. The top surface 127 of the plug pedestal 108 is preferably planar to permit it to be placed onto one of the circuit boards 133 by means of a known vacuum pick and place mechanism. Moreover, as shown in FIG. 11, the top surface 127 is preferably sufficiently broad to protect contact heads 121*a* from impact by the receptacle connector component 110 during mating. Furthermore, the top surface 127 has radiused edges 127*a* to facilitate mating with the receptacle connector component 110.

The terminals 106 of the plug connector component 102 differ slightly from the terminals 7 of the first embodiment described above with respect to the disposition of the terminal locking portion relative to the terminal housing engagement portion. As shown in FIGS. 11 and 12, each terminal 106 of this second embodiment includes a horizontal base or body portion 120, a contact portion 121 extending upwardly therefrom in a cantilevered fashion, a solder tail portion 122 extending out of the plug connector housing 104, a plug connector housing retention portion 123 rising from the base portion 120, and an opposing connector housing locking portion 124 extending upwardly from the retention portion 123, also in a cantilevered fashion. A junction between the tail portion 122 and the body portion 120 includes a notch to resist the wicking of solder up the terminal 106 and affecting the housing 104. The contact and locking portion 121, 124 are spaced apart from each other and define a nest 125 therebetween that receives a sidewall 116 of an opposing receptacle connector housing 112 therein when the two connector components 102, 110 are mated together as shown in FIG. 12.

The plug connector terminals 106 are mounted in a plurality of terminal-receiving cavities 128 formed in the plug connector housing 104. These cavities 128 are spaced apart lengthwise along the interior portion of the plug connector component 102 and communicate with receptacle-receiving channels 129 defined therein. These cavities 128 may be considered as having two distinct portions 128*a*, 128*b*. The one portion 128*a* of each cavity 128 is formed primarily in the sidewalls 105 of the plug connector housing 104 to receive both the housing retention portion 123 and the locking portions 124 of each terminal 106. The other portion 128*b* is formed primarily in the pedestal 108 of the plug connector 102 to receive the terminal contact portion 121.

The receptacle connector component 110 has a plurality of conductive metal terminals 114. Each terminal has a vertical contact portion 115 with an outer surface embedded in the receptacle sidewall 116 and an inner surface exposed. Inner surfaces of these portions are supported from the inside during insert molding. Therefore, the inner surfaces of these portions preferably lie flush with the interior surfaces 117 of the receptacle housing sidewalls 116 in opposition to the plug connector terminals 106 when the two connector components are mated together. A horizontal top portion 115*a* orthogonally extends from an upper end of the contact portion 115 into a top of the sidewall 116 as described in the first embodiment. A lower end of the contact portion orthogonally extends out a recess 113*a* in the floor 113 of the housing to provide a horizontal intermediate portion 118. A tail portion 119 orthogonally extends from the intermediate portion 118 for soldering to circuit traces on a board 133. The intermediate portion 118 is provided with a notch 118*a* to resist solder from wicking up the terminal. The upper corners 131 of the plug housing sidewalls 116 are ramped, or inclined, at a predetermined angle in order to facilitate the interengagement of the two connector components 102, 110 together. These inclined corners 131 are beneficial in the blind mating of the connector components 102, 110 together.

In this embodiment, the locking portions 124 of the plug terminals 106 are coincident with and extend up from the housing retention portions 123. The locking portions 124 of the terminals 106 are still spaced apart from the terminal contact portions 121 to define a nest 125 that coincides with the channels 129 that are defined within the plug connector housing 102 between the plug connector and locking portion 124. The nests 125 and channels 129 also coincide and receive the sidewalls 116 of the receptacle housing 112 during engagement of the two connector components 102, 110.

The placement of the locking portions 124 in this location is beneficial because any deflection that will occur in the terminal locking portion 124 will occur around the junction of the housing retention portion 123 rather than in the horizontal body portion 120 of the plug connector terminals 106 as in the first embodiment. The housing retention portion 123 has a larger area to resist stress and itself is restrained from significant movement due to its retention in the plug housing 104 with its barbs 126. This relocation reduces, and may altogether remove, any detrimental stress from the horizontal portion of the terminal base portion 120 that occurs due to deflection of the locking portions 124.

Thus, in this second embodiment, when the contact portions 121 of the plug connector terminals 106 initially deflect upon insertion of the receptacle housing 112 into the plug connector nest 125, the deflection of the terminal contact portions is the only contributor to stress in the terminal base portions 120. In the first embodiment, the terminal base portions undergo additional stress due to deflection of the terminal locking portions 15. Thus, the terminal locking portion 124 of the second embodiment may be considered as structurally isolated from the terminal base portion 120, leading to a more durable connector assembly in withstanding repeated cycles of engagement and disengagement.

In the engagement of the two connector components 102, 110 together, the contact portions 121 of the plug terminals 106 are spread apart, i.e., outwardly from their initial configuration shown in FIG. 11 by the interior surfaces 117 of the receptacle housing sidewalls 116 and specifically the terminals 114 thereof. The contact portions 121 will deflect inwardly from their initial position and the exterior surfaces 135 of the receptacle housing sidewalls 116 will impinge upon the plug housing terminal locking portions 124 and cause them to deflect slightly outwardly. The terminal locking portions 124 will then engage the opposing recesses 138 that include shoulder portions 140 which the heads 136 of the terminal locking portions engage.

While the preferred embodiments of the invention have been shown and described, it will be apparent to those skilled in the art that changes and modifications may be made therein without departing from the spirit of the invention, the scope of which is defined by the appended claims.

We claim:

1. A surface mount electrical connector for engaging with a corresponding opposing surface mount electrical connector in order to effect a connection between two circuit boards, said connector comprising: a connector housing formed from an electrically insulative material, a channel disposed in the connector housing and extending along a preselected axis of said connector housing, the connector housing channel being adapted to receive a corresponding projecting portion therein of said opposing connector, a plurality of electrically conductive terminals disposed in spaced-apart order in said connector housing along said connector housing axis, the terminals each including a connector housing retention portion for retaining said terminal in place in said spaced-apart order in said connector housing, a contact portion including a contact head projecting into said channel for contacting an opposing terminal of said opposing connector, and an engagement portion including a locking head projecting into said channel for engaging a portion of said opposing connector inserted into said connector housing channel and for retaining said opposing connector portion in place within said connector housing channel, an innermost surface of said contact head being disposed at a different height than an innermost surface of said locking head, said terminal contact head and locking head being disposed in said connector housing in communication with said connector housing channel and along opposite sides of a centerline of said connector housing channel, said terminal contact head and locking head further cooperatively engaging any opposing connector portion inserted into said connector housing channel.

2. The connector as defined in claim 1, wherein said engagement portion of said terminals is spaced apart from said contact portion to define an intervening nest therebetween that receives part of said opposing connector when said opposing connector is mated to said connector.

3. The connector as defined in claim 1, wherein said retention portion is spaced apart from said contact portion.

4. The connector as defined in claim 3, wherein said retention portion is spaced apart from said engagement portion.

5. The connector as defined in claim 3, wherein said retention portion is disposed in said housing coincident with said engagement portion.

6. The connector as defined in claim 1 further including a central pedestal portion flanked on at least two sides thereof by parallel sidewalls, said pedestal portion being separated from said sidewalls by intervening spaces, the intervening spaces for receiving sidewalls of said opposing connector sidewalls therein when said connector is engaged with said opposing connector.

7. The connector as defined in claim 6, wherein a top of said pedestal portion and top edges of said sidewalls lie in one plane.

8. The connector as defined in claim 6, wherein said pedestal portion includes cavities for receiving contact portions of said terminals.

9. The connector as defined in claim 8, wherein said pedestal includes a broad cap for protecting contact heads of said contact portions in said cavities from a portion of an opposed connector during engagement of said opposing connector with said connector.

10. The connector as defined in claim 9, wherein said broad cap of said pedestal portion has radiused outer edges to facilitate insertion of corresponding portions of an opposed connector during engagement of said opposing connector with said connector.

11. The connector as defined in claim 6, wherein said engagement and contact portions of said terminals are disposed in communication within said intervening spaces.

12. A surface mount electrical connector for engaging with a corresponding opposing surface mount electrical connector in order to effect a connection between two circuit boards, said connector comprising: a housing including at least a pair of sidewalls having opposing interior and exterior surfaces and conductive terminals disposed along said interior surfaces of said sidewall, said terminals each having a contact portion disposed within a portion of said housing and interconnected to a solder tail portion extending out of said housing, said housing including engagement surfaces defined on the exterior surfaces thereof for engaging respective, opposing engagement portions of terminals in said opposing connector when said connector is engaged to said opposing connector to interlock said connector and said opposing connector together against disengagement.

13. The connector as defined in claim 12, wherein said engagement surfaces include shoulders disposed on said receptacle connector sidewalls for resisting disengagement by said engagement portions of said opposing connector when said connector and said opposing connector are engaged.

14. The connector as defined in claim 12, wherein said terminal includes a top portion which orthogonally extends from said contact portion of said terminal at an intersection therebetween and enters into said housing, and a radiused recess disposed in an interior corner of said intersection filled with a portion of said housing.

15. The connector as defined in claim 14, wherein an exterior corner of s aid intersection is radiused to facilitate engagement with a portion of an opposing connector when said connector and said opposing connector are engaged.

16. A surface mount electrical connector for connecting two circuit boards together, the connector including first and second interengaging connector components, the first and second connector components including respective first and second connector housings and respective first and second sets of conductive terminals, each of the conductive terminals having a contact portion disposed within a portion of the respective one of said first and second connector housings, a solder tail portion extending out of said connector housing and a body portion interconnecting said contact and said solder tail portions, each of said first set of terminals further including a second housing engagement portion and said second connector housing including engagement surfaces defined thereon each in opposition to a respective one of said first terminal set second housing engagement portions such that said first terminal set second housing engagement portions engage respective ones of said second connector housing engagement surfaces to interlock said first and second connector housings together against disengagement.

17. The electrical connector as defined in claim 16, wherein said second housing engagement portions and contact portions are separated by an intervening space and said second connector housing is received within said intervening space when said first and second connector housings are engaged together.

18. The electrical connector as described in claim 17, wherein said second connector housing has side walls which have a thickness that is greater than said first terminal intervening spaces, and wherein said second connector housing walls are received within said first terminal intervening spaces when said first and second connector housings are engaged together.

19. The electrical connector as described in claim 16, wherein said contact portions and second connector housing engagement portions of said first terminal set are disposed on said first terminals at different relative elevations within said first connector housing, whereby, when said first and second connector housings are brought together into engagement, said first terminal set contact portions engage said second connector component before said first terminal set second connector housing engagement portions engage said second connector component.

20. An electrical connector for engaging with a corresponding opposing electrical connector in order to effect a connection between two circuit boards, said connector comprising: a housing including at least a pair of sidewalls having opposing interior and exterior surfaces and conductive terminals disposed along said interior surfaces of said sidewall, said terminals each having a contact portion disposed within a portion of said housing and interconnected to a solder tail portion extending out of said housing, said housing including engagement surfaces defined on the exterior surfaces thereof for engaging respective, opposing engagement portions of terminals in said opposing connector when said connector is engaged to said opposing connector to interlock said connector and said opposing connector together against disengagement.

* * * * *